US008584883B2

(12) United States Patent
Escarpa Gil

(10) Patent No.: US 8,584,883 B2
(45) Date of Patent: Nov. 19, 2013

(54) COLLAPSIBLE BOX

(75) Inventor: Julián Escarpa Gil, Aldaia (ES)

(73) Assignee: SP Berner Plastic Group, S.L., Aldaia (Valencia) (ES)

( * ) Notice: Subject to any disclaimer, the term of this patent is extended or adjusted under 35 U.S.C. 154(b) by 90 days.

(21) Appl. No.: 13/277,358

(22) Filed: Oct. 20, 2011

(65) Prior Publication Data

US 2012/0091133 A1 Apr. 19, 2012

Related U.S. Application Data

(63) Continuation of application No. PCT/ES2009/070508, filed on Nov. 17, 2009.

(30) Foreign Application Priority Data

Jun. 15, 2009 (ES) ..... 200930306

(51) Int. Cl.
*B65D 6/18* (2006.01)

(52) U.S. Cl.
USPC ..... 220/7; 220/6

(58) Field of Classification Search
USPC ..... 220/6, 7
See application file for complete search history.

(56) References Cited

U.S. PATENT DOCUMENTS

| | | | | |
|---|---|---|---|---|
| 6,290,081 | B1 | 9/2001 | Merey | |
| 7,128,231 | B2 * | 10/2006 | Overholt | 220/4.28 |
| 2004/0159659 | A1 * | 8/2004 | Rumpel | 220/7 |
| 2004/0182858 | A1 | 9/2004 | Smyers | |
| 2004/0226945 | A1 | 11/2004 | Hsu et al. | |
| 2006/0231555 | A1 | 10/2006 | Smyers et al. | |
| 2007/0145053 | A1 * | 6/2007 | Escarpa Gil | 220/7 |

FOREIGN PATENT DOCUMENTS

| | | |
|---|---|---|
| CA | 2 309 234 | 11/2000 |
| EP | 1 477 414 | 11/2004 |
| EP | 1 655 232 | 5/2006 |
| EP | 2 036 825 | 3/2009 |
| WO | 2009/025627 | 2/2009 |

OTHER PUBLICATIONS

International Search Report issued Mar. 12, 2010 in International (PCT) Application No. PCT/ES2009/070508.

* cited by examiner

*Primary Examiner* — Stephen Castellano
(74) *Attorney, Agent, or Firm* — Wenderoth, Lind & Ponack, L.L.P.

(57) ABSTRACT

A box includes, in principle, a plastic structure with a rectangular base, two ends, and two sides which are pivotably coupled to said base. The ends include centered parts combined with latches, which in one position anchor the sides and ends, while in another position said connection between the ends and the sides is released in order to collapse said elements and thus achieve a collapsed position. The box includes an anchor device consisting of a series of rotary bodies (5) that connect the bolts of the lock (4) to the centered part (1) via two pairs of resilient parts (6) and (7) which, in the inoperative position thereof, hold the bolts of the lock (4) outwards, attaching the ends (2) and the sides (9), and when the central part (1) is moved upward, the latches thus release the ends and the sides.

18 Claims, 4 Drawing Sheets

COLLAPSIBLE BOX

This application is a Continuation of International Application PCT/ES2009/070508, filed Nov. 17, 2009, which is hereby incorporated by reference in its entirety.

OBJECT OF THE INVENTION

The present invention, as expressed in the title of this specification, refers to a collapsible box, usually made of plastic, which generally comprises a base, to edges of which are hingely coupled the side walls: two major or flanks and two minor or front ends, the latter including a characteristic anchoring device that ensures the coupling and assembly of the four side walls and in general of the whole of the respective box, which will mainly made of plastic.

The box is designed for transporting food products, whether be packaged or not, such as for example fruits, vegetables, etc.

Thus, the object of the invention is a device that allows the person working with the box, to perform its folding and unfolding quickly and easily, acting on the devices included on the front ends, so that by folding the box its volume can be greatly reduced to then perform its storage and/or transport.

It also includes a characteristic hinged coupling between the sides and the bottom.

BACKGROUND OF THE INVENTION

There are currently known plastic boxes, among which are those that comprise folding side walls hinged at the edges of its base or bottom, so that when the box is not used, these side walls can be folded inward in parallel, horizontal and superimposed planes relative to the bottom of the box.

On the other hand, the side walls have anchoring means at their adjacent edges to ensure the assembly of the boxes during their use. In contrast, when the boxes are empty these anchoring means are released to bring down the side walls, and thus reducing the volume to a minimum space, very practical for storing and transporting empty boxes, for example.

To this type of boxes belongs e.g., the Utility Model No. 200302479, Invention Patent No. 200201794 which employ anchors that vertically go up and down to achieve the assembly and disassembly of the side walls corresponding to adjacent edges of their walls.

There are other boxes wherein the anchors are horizontally moved in opposite directions, in one case towards the center of the side walls for releasing the anchors and outwards to ensure the assembly of the box in the unfolded position for then fill it with some product.

In these cases, the anchors are similar to a conventional latch, so that implementation has shown that this type of anchors with horizontal displacements in opposite directions provide greater security than the first boxes that use the anchor with vertical displacement (Utility Model No. 200302479 and Invention Patent No. 200201794).

To this type of anchors with horizontal displacement belong for example to documents U.S. Pat. No. 6,293,418, CA2309234, CA2273556, U.S. Pat. No. 3,987,945, U.S. Pat. No. 5,632,392, ES2169280, U.S. Pat. No. 6,772,897.

In some of these documents, such as for example the Invention U.S. Pat. No. 5,632,392 and ES2169280, is required to individually act on each of the closures, which prevents their simultaneous operation using only one hand.

In contrast, Invention U.S. Pat. No. 6,293,418 does provide an embodiment in which the actuation device and anchoring elements are a single piece (FIGS. 10 and 11), so that by acting on a central area 196*a* an elastic deformation would occur by pulling the front end sections, simultaneously releasing two front end closures or anchors.

Invention Patent No. 200201794, although also has a single-piece device with pairs of front end anchors simultaneously moved by centrally acting on the device with one hand, the anchors are instead vertically actuated rather than horizontally, as occurs with most of the aforementioned boxes and also in the invention at hand.

It is also known the Invention Patent No. 200503207 owned by the same applicant that the invention at hand and referred to an anchoring device for collapsible boxes.

Said anchoring device, as the one for Invention Patent with publication number EP1655232, generally consists of anchoring devices located on the lower side walls or front ends and which have some side bolts associated with a central piece vertical displacement of which perpendicular moves the bolts for engaging or disengaging the major and minor side walls.

Each of the devices exclusively uses elastic means to move the bolts when manually acting on a control piece.

DESCRIPTION OF THE INVENTION

In order to achieve the objectives and avoid the drawbacks mentioned in the preceding paragraphs, the invention proposes a collapsible box, essentially made of plastic, which in principle comprises a base, edges of which are hingedly coupled two major side walls or flanks and two minor side walls or front ends in order to allow folding the box by folding down the front ends until placing on the base on a superimposed parallel plane, and lowering at a later stage the flanks that will be arranged on another parallel plane superimposed on the front ends.

To do this, we must first release the anchor of the front ends and flanks acting on some characteristics anchoring devices built into each front end.

Each of the aforementioned anchoring devices is characterized in that they comprise a pair of rotary bodies coupled in front axle perpendicularly arranged to the plane formed by the front ends, said rotary bodies connecting a vertically movable centered control piece and a pair of horizontally movable side bolts, through which the side walls are anchored when the anchoring device is at resting position, while when the two mentioned devices are manually activated with the hands the anchor of the side walls is released, which activation is performed by moving up the central piece, which by stop acting thereon, the device returns to its resting position.

The rotary bodies are connected to the bolts and central pieces by thin elastic portions, so that at resting position, the central piece remains in a lower position and bolts in an anchoring position with the latches protruding with respect to side edges of the front ends, so that such latches will be inserted in complementary recesses on the flanks.

However, when the central piece is moved up against the resistance of the elastic portion associated by means of the rotary bodies, the bolts are horizontally retracted approaching to each other in the same direction but in opposite senses, the latches being hidden with respect to side edges of the front ends. In this situation, the front ends can be folded inward to start bending the box, placing the front ends on the base and then folding down the flanks until placing them on the front ends, such as stated earlier.

Once stop pressing upward on the centered piece all elements of the anchoring device recover their resting position in which the bolts are in their anchoring position with latches protruding from the side edges of the front ends, so that the side walls are in their assembled position, said side walls being anchored together thus ensuring the assembly of the entire box.

Each time the centered control piece is moved by the upward manually actuation or as a consequence of downward push due to the elastic portions, the rotary bodies pivot in either direction facilitating the mobility of the bolts and in general of the assembly of each anchoring device installed on the front ends of the box.

In a preferred embodiment, the rotary bodies are coupled to shafts integral with the front ends.

In another embodiment the rotary bodies may have axes coupled to complementary holes of the front ends.

In another embodiment, the hinge shaft could be a separate shaft.

Finally, in another embodiment it may be possible that the hinge shafts themselves constitute each of the rotary bodies.

Another feature of the invention relates to the unique hinged connection between the side walls and the bottom.

Next, to facilitate a better understanding of this specification and being an integral part thereof, some figures in which the object of the invention has been represented in an illustrative and not limitative manner are attached.

DESCRIPTION OF THE PREFERRED EMBODIMENT

Figure 1:
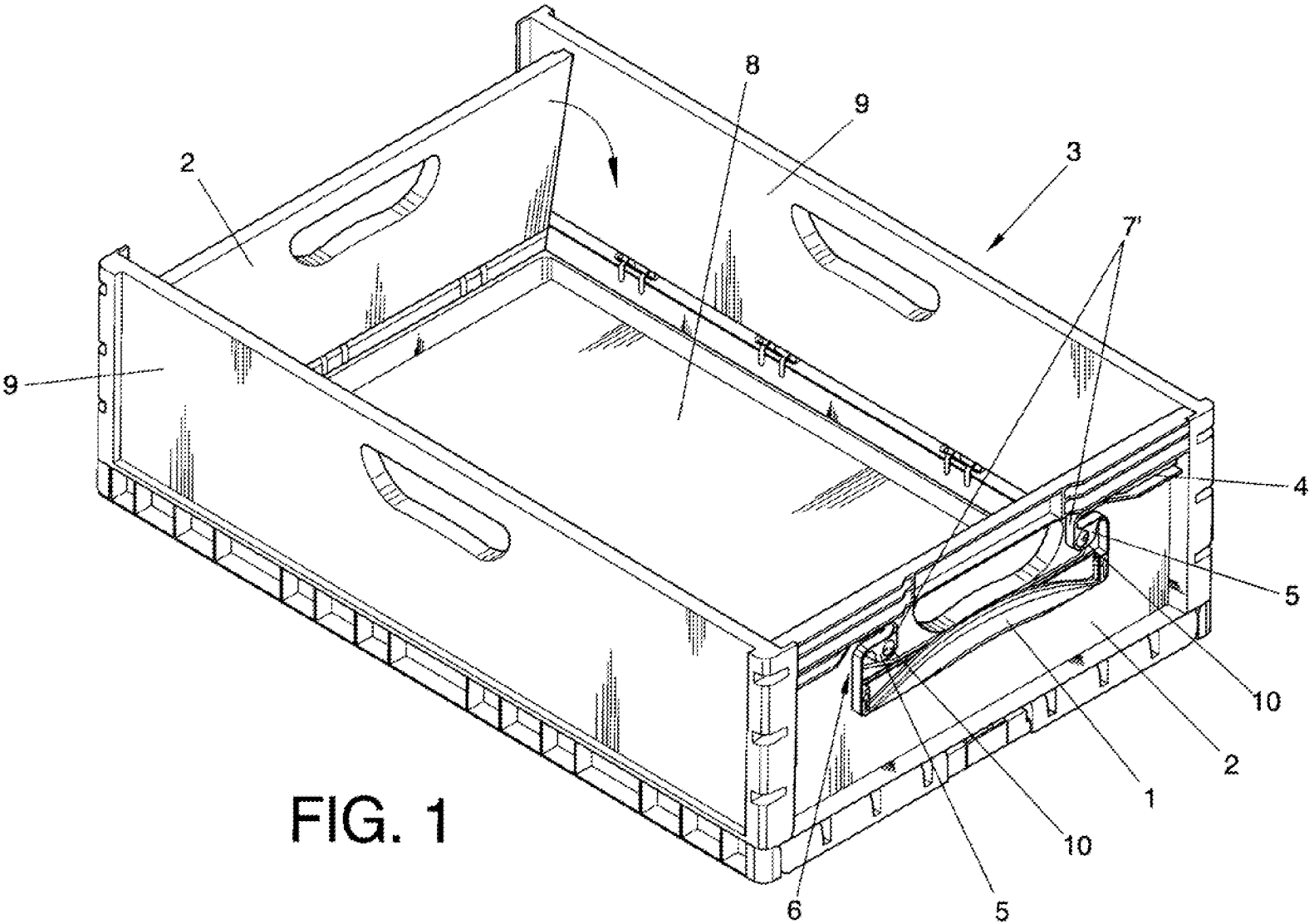
FIG. 1.—Shows a perspective view of a collapsible box, object of the invention. Basically each of the front ends of the box includes a characteristic anchoring device that associates the four side walls (front ends and flanks).
Figure 2:
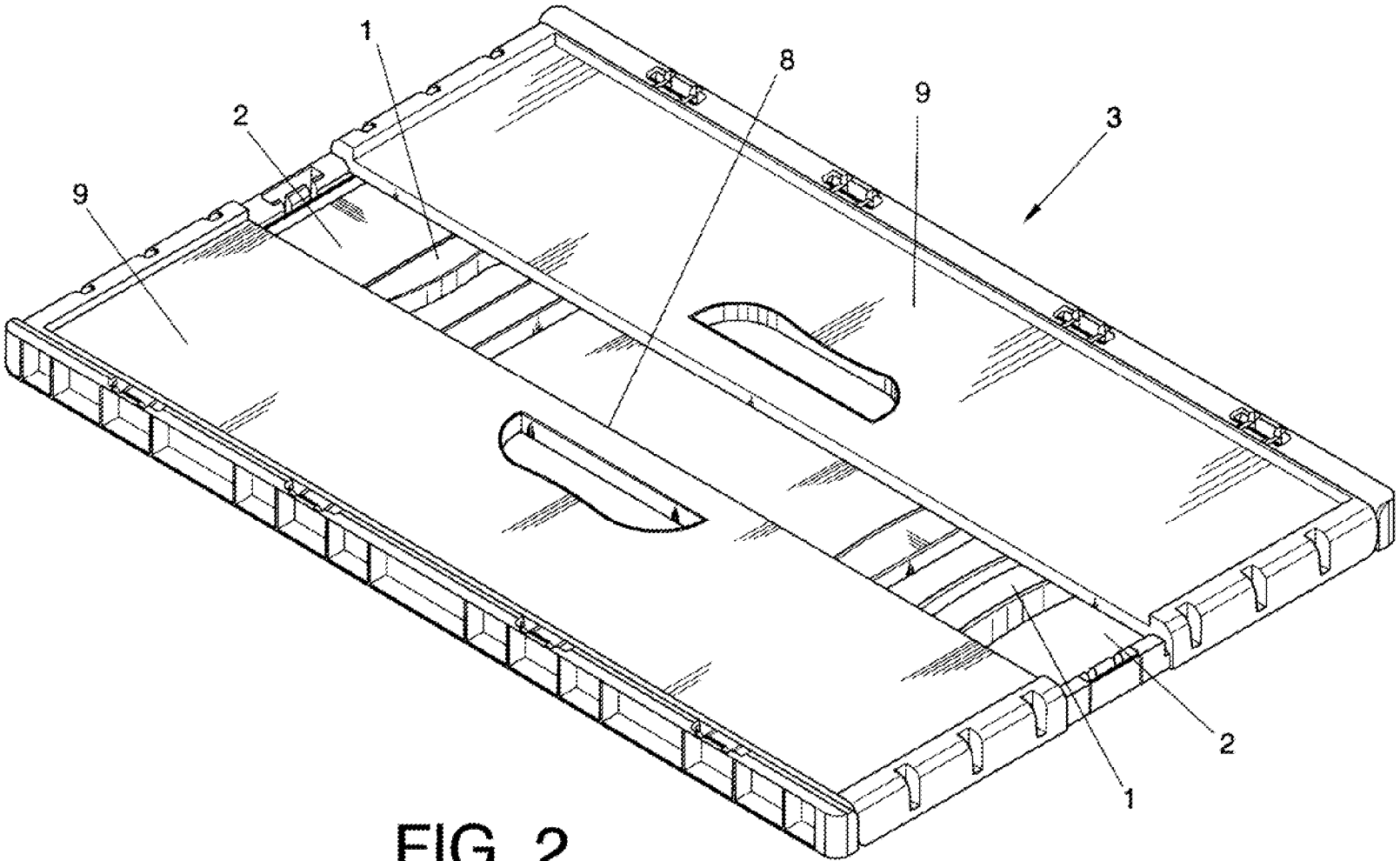
FIG. 2.—Shows a view of the box in the fully folded position in which the front ends and flanks are arranged in superimposed planes parallel to the base of the box.
Figure 3:
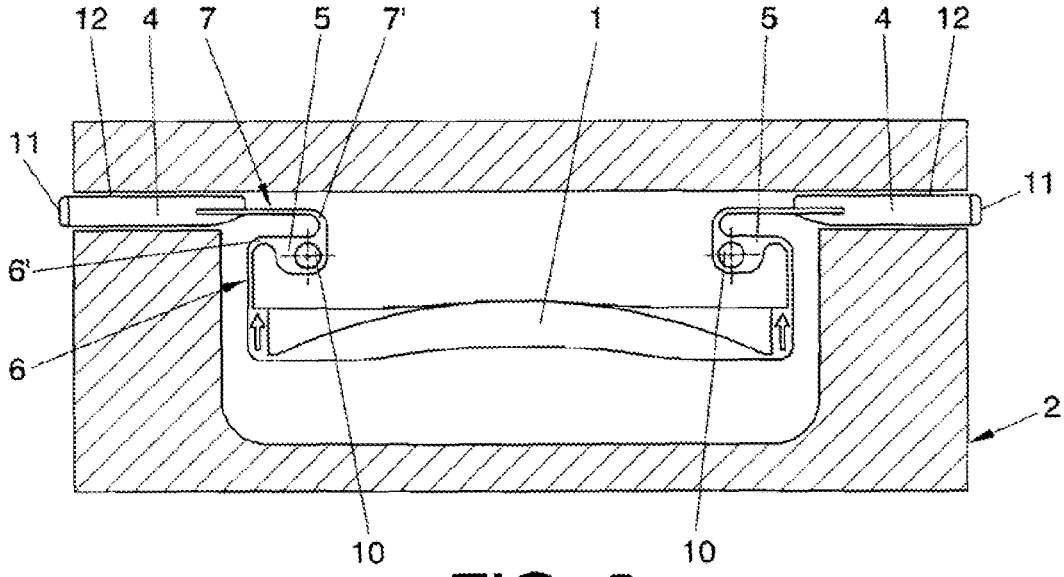
FIG. 3.—Shows a perspective view of the hinged coupling between the side walls and the bottom of the box.
Figure 4:
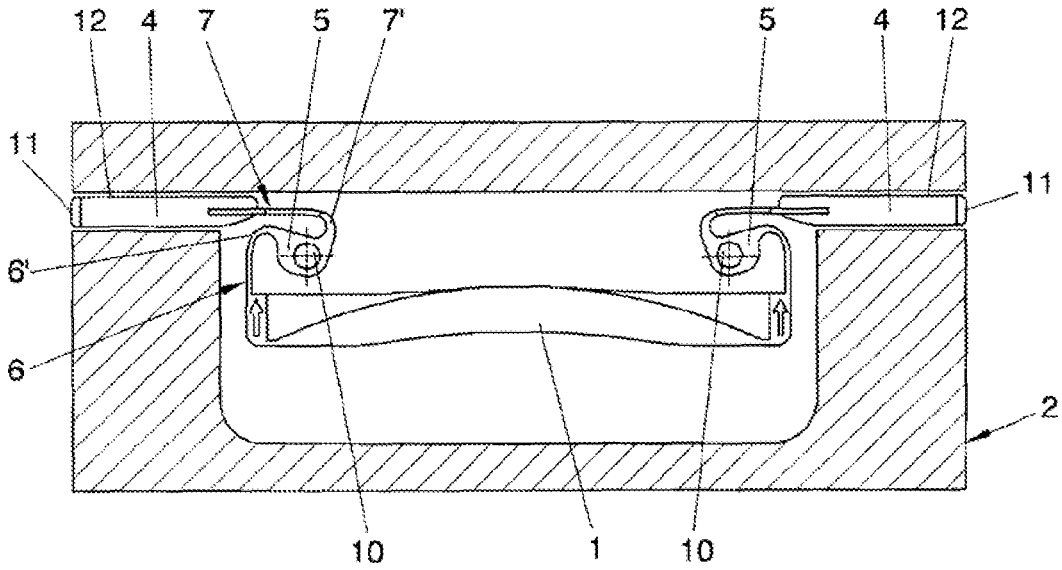
FIG. 4.—Shows a front view of the anchoring device in the active engaging position.
Figure 5:
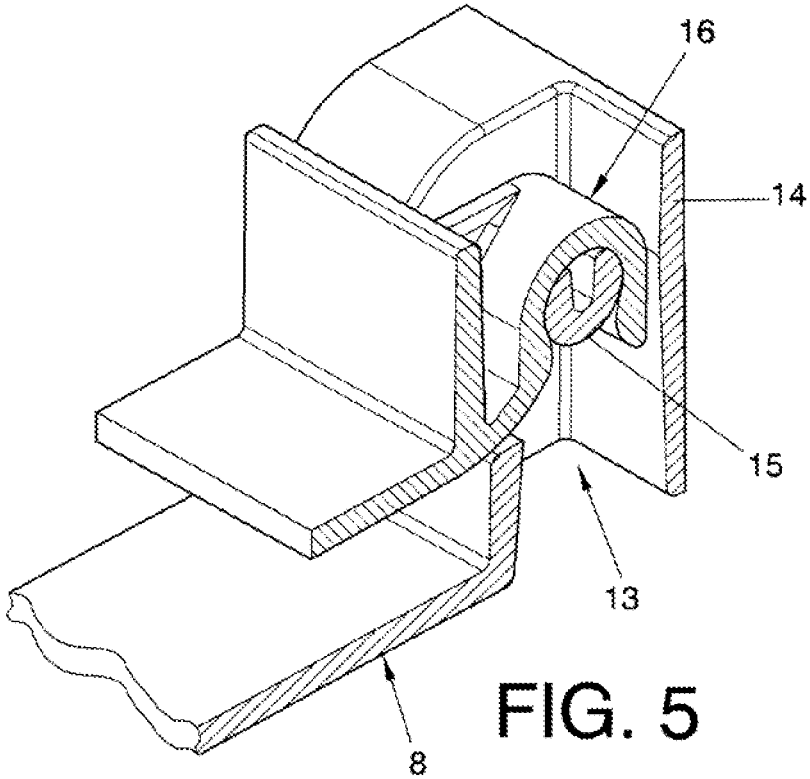
FIG. 5.—Shows a perspective view of the hinged coupling between the side walls and the bottom of the box.
Figure 6:
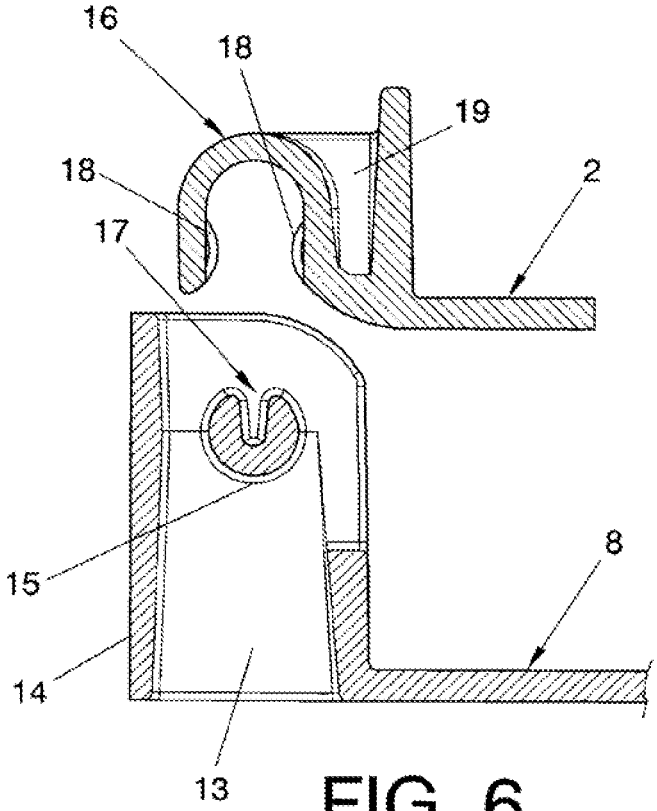
FIG. 6.—Shows an exploded side view of what is represented in the previous figure.

Considering the numbering adopted in the figures, the collapsible box includes two anchoring devices, each of which is determined from a central control piece 1 arranged in correspondence with each of the front ends 2 of a plastic box 3, which control piece 1 is connected to a pair of side bolts 4 through rotary bodies 5 and two pairs of thin elastic portions 6 and 7, about 6 that connect the front ends of the central piece 1 to the rotary bodies 5 while the other pair of elastic portions 7 associates the rotary bodies 5 with the side bolts 4. These are lead and guided into complementary slots 12.

The box 3 generally comprises a base or bottom 8, on the edges of which are hingedly coupled two major side walls or flanks 9 and the two mentioned minor side walls or front ends 2, so that to reach the folded position, the front ends 2 are first folded down until being placed on a plane superimposed on the base 8, to then folding down the flanks 9 until being placed on another plane superimposed on the front ends 2 already folded.

The rotary bodies 5 are hingedly coupled to shafts 10 integral with the own front ends 2. In turn, the bolts include front end latches 11, which protrude from the side edges of the front ends 2 in a resting position and through which the front ends 2 are anchored in the flanks 9 during the assembly of the box.

The elastic portions 6 and 7 comprise straight sections with extreme short curved elbows 6' and 7', through which they are attached to the rotary bodies 5 while the straight sections of the elastic pieces 7 are attached to the bolts 4 in the same direction as them. Instead, the straight sections of the other elastic paired pieces 6 are attached perpendicular to the front ends of the central control piece 1.

The elongated straight sections of the elastic portions comprise horizontally extending sections which are arranged in the same direction as the bolts and guiding slots of said bolts, and also comprise vertically extending sections which are perpendicularly attached to the front ends of the central control piece.

With this described arrangement, when we simultaneously move upward the two central pieces 1 of the front end 1 against the resistance of the elastic portions 6 and 7, and with the assembled box being in the unfolded position, the bolts 4 are horizontally moved toward the center of the front ends 2 hiding the latches 11, thereby releasing the front ends 2 by folding down until being placed on a plane superimposed on the base 8, then folding down the flanks 9 until being stable and supported on the front ends 2.

For the unfolding process the same will be performed, but folding down the side walls in opposite directions, first pivoting the flanks 9 and then the front ends, maintaining pressed during the folding down of the latter the centered pieces so as the latches be hidden from and do not bump into the inner faces of the flanks.

The hinged coupling between the bottom 8 and the front ends 2 and flanks 9 is determined from some recesses 13 provided in a high perimeter partition wall 14 of the bottom 8, in which recesses 13 are the shafts 15 which hingedly couple by snap fits some "C"-shaped female terminal portions 16 integral with the lower edge of the front ends 2 and flanks 9. Such shafts 15 are affected with a longitudinal channel 17.

The mouth of said female terminal portions 16 includes curved and faced appendices 18 providing the aforementioned elastic coupling and which also ensure the stability and fixation of said hinged coupling.

The female terminal portions 16 are reinforced by ribs 19 that stiffen and strengthen the connection of said female terminal portions 16 to the rest of the front ends 2 and flanks 9.

Finally, note that the hinged coupling of the front ends 2 and flanks 9 and the bottom 8 is performed with said front ends 2 and flanks 9 being in a folded or nearly folded position, so that the accidental removal of the side walls in position for use is impossible, which provides a total security for the assembly of the box.

The invention claimed is:

1. A collapsible box, comprising a rectangular base, on edges of which two major side walls that define flanks and two minor side walls that define front ends are hingedly coupled, and included in two opposite ones of said side walls, anchoring devices that include vertically movable central control pieces associated with horizontally actuated bolts, which in one position anchor the side walls through the extreme latches of the bolts and in another position release that anchor in order to fold down the four side walls on superimposed planes above the base, rotary bodies connecting the bolts to the central control pieces through two pairs of elastic portions, which in a resting position maintain the latches outwards engaging the front ends and the flanks, whereas when the central control pieces are moved upward against the resistance of the elastic portions, the latches are hidden releasing the front ends and the flanks, wherein the rotary bodies are hingedly coupled to short axes perpendicular to the plane formed by the front ends.

2. The collapsible box according to claim 1, wherein the axes are integral with the front ends.

3. The collapsible box according to claim 1, wherein the axes comprise independent bodies.

4. The collapsible box according to claim 3, twherein the axes are attached to the front ends.

5. The collapsible box according to claim 3, wherein the axes are attached to the rotary bodies.

6. The collapsible box according to claim 1, wherein the short axes are integral with the rotary bodies themselves, which axes are coupled in complementary holes provided in the front ends.

7. The collapsible box according to claim 6, wherein the rotary bodies constitute the very hinged axes.

8. The collapsible box according to claim 1, wherein the elastic portions comprise elongated straight sections and short curved elbows attached to the rotary bodies.

9. The collapsible box according to claim 8, wherein the elongated straight sections of the elastic portions comprise horizontally extending sections which are arranged in the same direction as the bolts and guiding slots of said bolts.

10. The collapsible box according to claim 9, wherein the elongated straight sections of the elastic portions comprise vertically extending section which are perpendicularly attached to the front ends of the central control pieces.

11. The collapsible box according to claim 8, wherein the elongated straight sections of the elastic portions comprise vertically extending sections which are perpendicularly attached to the front ends of the central control pieces.

12. The collapsible box according to claim 1, wherein the hinged coupling between the base and the front ends and flanks is determined from recesses established in a high perimeter partition wall of the base, in the recesses of which are axes wherein "C"-shaped female terminal portions integral with the lower edge of the front ends and flanks are hingedly coupled by snap fit, which coupling is performed in a folded position of said front ends and flanks.

13. The collapsible box according to claim 12, wherein the hinge axes are affected with a longitudinal channel.

14. The collapsible box according to claim 13, wherein the mouth of the female terminal portions include arched facing appendages.

15. The collapsible box according to claim 13, wherein the female terminal portions are reinforced by ribs to stiffen and strengthen the connection of such female portions to the rest of the front ends and flanks.

16. The collapsible box according to claim 12, wherein the mouth of the female terminal portions include arched facing appendages.

17. The collapsible box according to claim 16, wherein the female terminal portions are reinforced by ribs to stiffen and strengthen the connection of such female portions to the rest of the front ends and flanks.

18. The collapsible box according to claim 12, wherein the female terminal portions are reinforced by ribs to stiffen and strengthen the connection of such female portions to the rest of the side walls.

* * * * *